US009624867B2

(12) United States Patent
Dölker

(10) Patent No.: US 9,624,867 B2
(45) Date of Patent: Apr. 18, 2017

(54) METHOD FOR THE CLOSED-LOOP CONTROL OF THE RAIL PRESSURE IN A COMMON-RAIL INJECTION SYSTEM OF AN INTERNAL COMBUSTION ENGINE

(75) Inventor: Armin Dölker, Friedrichshafen (DE)

(73) Assignee: MTU FRIEDRICHSHAFEN GMBH, Friedrichshafen (DE)

( * ) Notice: Subject to any disclaimer, the term of this patent is extended or adjusted under 35 U.S.C. 154(b) by 383 days.

(21) Appl. No.: 13/381,878

(22) PCT Filed: Jun. 17, 2010

(86) PCT No.: PCT/EP2010/003654

§ 371 (c)(1),
(2), (4) Date: Dec. 30, 2011

(87) PCT Pub. No.: WO2011/000480

PCT Pub. Date: Jan. 6, 2011

(65) Prior Publication Data

US 2012/0097131 A1 Apr. 26, 2012

(30) Foreign Application Priority Data

Jul. 2, 2009 (DE) ..... 10 2009 031 528

(51) Int. Cl.
*F02M 69/46* (2006.01)
*F02D 41/38* (2006.01)
(Continued)

(52) U.S. Cl.
CPC ..... *F02D 41/3854* (2013.01); *F02D 41/3863* (2013.01); *F02M 63/025* (2013.01);
(Continued)

(58) Field of Classification Search
CPC ..... F02D 41/3845; F02D 41/3809; F02D 41/3827; F02D 41/3836; F02D 41/3854;
(Continued)

(56) References Cited

U.S. PATENT DOCUMENTS 5,085,193 A * 2/1992 Morikawa ..... F02D 41/045 123/458
5,201,294 A * 4/1993 Osuka ..... F02D 41/221 123/198 D (Continued)

FOREIGN PATENT DOCUMENTS

CN 1127842 A 7/1996
DE 19731994 1/1999

(Continued)

*Primary Examiner* — Hung Q Nguyen
*Assistant Examiner* — Brian Kirby
(74) *Attorney, Agent, or Firm* — Lucas & Mercanti, LLP; Klaus P. Stoffel

(57) ABSTRACT

Proposed is a method for open-loop and closed-loop control of an internal combustion engine (1), the rail pressure (pCR) being controlled via a low pressure-side suction throttle valve (4) as the first pressure-adjusting element in a rail pressure control loop. The invention is characterized in that a rail pressure disturbance variable is generated to influence the rail pressure (pCR) via a high pressure-side pressure control valve (12) as the second pressure-adjusting element, by means of which fuel is redirected from the rail (6) into a fuel tank (2).

5 Claims, 6 Drawing Sheets

(51) Int. Cl.
*F02M 63/02* (2006.01)
*F02D 41/14* (2006.01)
*F02D 41/20* (2006.01)

(52) U.S. Cl.
CPC .... *F02D 41/1401* (2013.01); *F02D 2041/141* (2013.01); *F02D 2041/1418* (2013.01); *F02D 2041/1432* (2013.01); *F02D 2041/2027* (2013.01); *F02D 2250/31* (2013.01)

(58) Field of Classification Search
CPC ..... F02D 41/3863; F02D 41/3872; F02D 41/3082; F02D 41/38
USPC ..... 123/446, 447, 514, 456, 457, 458, 511, 123/495, 497, 494, 198 D, 179.16, 123/339.24, 399, 690, 357, 506; 701/113, 701/102, 103, 104, 105; 239/533.2
See application file for complete search history.

(56) References Cited

U.S. PATENT DOCUMENTS 5,284,119 A * 2/1994 Smitley ..... F02D 33/006 123/497
5,423,303 A * 6/1995 Bennett ..... F02M 69/465 123/456
5,622,152 A 4/1997 Ishida
5,632,144 A * 5/1997 Isobe ..... F02D 41/005 60/277
5,718,207 A * 2/1998 Ito ..... F02M 37/08 123/179.16
5,975,061 A * 11/1999 Briggs ..... F02M 69/54 123/514
6,016,791 A * 1/2000 Thomas et al. ..... 123/497
6,024,064 A * 2/2000 Kato ..... F02D 41/065 123/179.17
6,119,655 A * 9/2000 Heinitz ..... F02D 41/20 123/447
6,142,120 A * 11/2000 Biester ..... F02D 41/3082 123/446
6,234,148 B1 * 5/2001 Hartke et al. ..... 123/447
6,257,204 B1 * 7/2001 Kamijo ..... F02D 41/3809 123/179.17
6,257,209 B1 * 7/2001 Hyodo ..... F02D 37/02 123/516
6,279,532 B1 * 8/2001 Takano ..... F02D 41/061 123/357
6,279,541 B1 * 8/2001 Doane ..... F02D 41/3082 123/497
6,293,253 B1 * 9/2001 Arnold ..... F02D 41/38 123/446
6,457,459 B1 * 10/2002 Schelhas ..... F02M 37/0023 123/509
6,578,553 B1 * 6/2003 Schubert ..... F02D 41/062 123/457
6,823,847 B2 * 11/2004 Carlo ..... 123/458
6,840,228 B2 * 1/2005 Yomogida ..... F02D 41/3836 123/447
6,895,936 B2 * 5/2005 Kuroda ..... F02M 63/025 123/446
6,912,983 B2 * 7/2005 Okamoto ..... F02D 41/062 123/179.1
7,040,291 B2 * 5/2006 Veit ..... 123/458
7,171,944 B1 * 2/2007 Oono ..... F02M 37/04 123/357
7,240,667 B2 * 7/2007 Dolker ..... 123/456
7,243,636 B2 * 7/2007 Joos ..... F02D 41/3836 123/446
7,270,115 B2 * 9/2007 Dolker ..... F02D 41/3845 123/447
7,347,188 B2 * 3/2008 Ohshima ..... 123/458
7,610,901 B2 * 11/2009 Bucher et al. ..... 123/457
7,779,819 B2 * 8/2010 Serra et al. ..... 123/514
7,848,868 B2 * 12/2010 Nakagawa ..... F02D 41/3863 123/357
8,061,331 B2 * 11/2011 Tsukada ..... F02D 41/3863 123/458
8,424,508 B2 * 4/2013 Adler ..... F02D 41/1401 123/458
9,441,572 B2 * 9/2016 Dolker ..... F02D 41/3863
2003/0226546 A1 * 12/2003 McIntyre ..... F02M 37/106 123/463
2005/0092301 A1 * 5/2005 Fukuda ..... F02M 59/366 123/446
2006/0130813 A1 * 6/2006 Dolker ..... 123/458
2006/0225707 A1 * 10/2006 Eser ..... F02D 41/3836 123/458
2008/0092852 A1 * 4/2008 Bucher et al. ..... 123/457
2008/0257314 A1 * 10/2008 Veit ..... F02D 41/1401 123/511
2009/0082946 A1 * 3/2009 Ishizuka ..... F02D 41/1498 701/106
2009/0260428 A1 * 10/2009 Yamashita ..... F02D 41/18 73/114.31
2009/0326788 A1 * 12/2009 Yuasa ..... F02D 41/3809 701/104
2010/0236221 A1 * 9/2010 Handa ..... F01N 3/0885 60/276
2010/0269794 A1 * 10/2010 Li ..... F02D 41/3845 123/495

FOREIGN PATENT DOCUMENTS

DE 19731995 1/1999
DE 19802583 8/1999
DE 10318827 A 2/2004
DE 10261414 7/2004
DE 10261446 A 7/2004
DE 10330466 10/2004
DE 102004061474 A1 3/2006
DE 102004059330 6/2006
DE 19731994 B4 11/2007
DE 102006040441 2/2008
DE 102006049266 A 3/2008
DE 2008090033 A 7/2008
DE 102007052092 A 5/2009
DE 102007052451 A 5/2009
DE 102007059352 6/2009
DE 102007059352 B3 * 6/2009 ..... F02D 41/3845
DE 102007061228 6/2009
EP 1030048 A2 * 8/2000 ..... F02D 41/38
GB 2327778 2/1999
GB 2327778 A 2/1999
GB 2327778 A * 2/1999 ..... F02D 41/38
GB 2331597 A * 5/1999 ..... F02D 41/38
JP 2003322048 A * 11/2003
WO WO/2006/061288 * 6/2006 ..... F02D 41/38
WO 2008090033 A1 7/2008

* cited by examiner

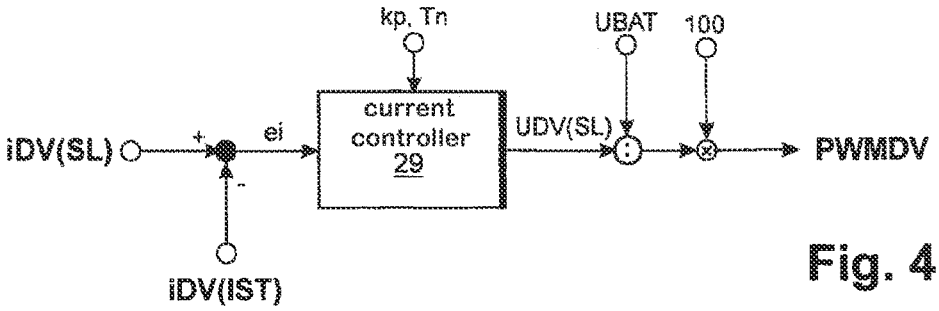
Fig. 4
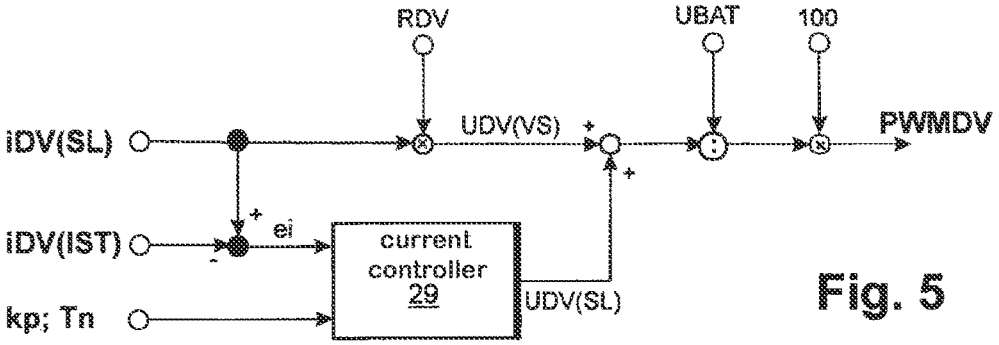
Fig. 5
22
| QSL [mm³/stroke] ⟶ \ nMOT [1/min] ⟶ | 0 | ... | 1000 | ... | 2000 |
|---|---|---|---|---|---|
| 270 | 0 | ... | 0 | ... | 0 |
| 240 | 0 | ... | 0 | ... | 0 |
| . | . | | . | | . |
| 120 | 0 | ... | 0 | ... | 0 |
| 90 | 0.5 | ... | 0.5 | ... | 0.5 |
| 60 | 1 | ... | 1 | ... | 1 |
| 30 | 1.5 | ... | 1.5 | ... | 1.5 |
| 0 | 2 | ... | 2 | ... | 2 |
Fig. 6

METHOD FOR THE CLOSED-LOOP CONTROL OF THE RAIL PRESSURE IN A COMMON-RAIL INJECTION SYSTEM OF AN INTERNAL COMBUSTION ENGINE

The present application is a 371 of International application PCT/EP2010/003654, filed Jun. 17, 2010, which claims priority of DE 10 2009 031 528.4, filed Jul. 2, 2009, the priority of these applications is hereby claimed and these applications are incorporated herein by reference.

BACKGROUND OF THE INVENTION

The invention concerns a method for the open-loop and closed-loop control of an internal combustion engine.

In an internal combustion engine with a common rail system, the quality of combustion is critically determined by the pressure level in the rail. Therefore, in order to stay within legally prescribed emission limits, the rail pressure is automatically controlled. A closed-loop rail pressure control system typically comprises a comparison point for determining a control deviation, a pressure controller for computing a control signal, the controlled system, and a software filter for computing the actual rail pressure in the feedback path. The control deviation is computed as the difference between a set rail pressure and the actual rail pressure. The controlled system comprises the pressure regulator, the rail, and the injectors for injecting the fuel into the combustion chambers of the internal combustion engine.

DE 197 31 995 A1 discloses a common rail system with closed-loop pressure control, in which the pressure controller is equipped with various controller parameters. The various controller parameters are intended to make the automatic pressure control more stable. The pressure controller then uses the controller parameters to compute the control signal for a pressure control valve, by which the fuel drain-off from the rail into the fuel tank is set. Consequently, the pressure control valve is arranged on the high-pressure side of the common rail system. This source also discloses an electric pre-feed pump or a controllable high-pressure pump as alternative measures for automatic pressure control.

DE 103 30 466 B3 also describes a common rail system with closed-loop pressure control, in which, however, the pressure controller acts on a suction throttle by means of a control signal. The suction throttle in turn sets the admission cross section to the high-pressure pump. Consequently, the suction throttle is arranged on the low-pressure side of the common rail system. This common rail system can be supplemented by a passive pressure control valve as a protective measure against excessively high rail pressure. The fuel is then redirected from the rail into the fuel tank via the opened pressure control valve. A similar common rail system is known from DE 10 206 040 441 B3.

Control leakage and constant leakage occur in a common rail system as a result of design factors. Control leakage occurs when the injector is being electrically activated, i.e., for the duration of the injection. Therefore, the control leakage decreases with decreasing injection time. Constant leakage is always present, i.e., even when the injector is not activated. This is also caused by part tolerances. Since the constant leakage increases with increasing rail pressure and decreases with falling rail pressure, the pressure fluctuations in the rail are damped. In the case of control leakage, on the other hand, the opposite behavior is seen. If the rail pressure rises, the injection time is shortened to produce a constant injection quantity, which leads to decreasing control leakage. If the rail pressure drops, the injection time is correspondingly increased, which leads to increasing control leakage. Consequently, control leakage leads to intensification of the pressure fluctuations in the rail. Control leakage and constant leakage represent a loss volume flow, which is pumped and compressed by the high-pressure pump. However, this loss volume flow means that the high-pressure pump must be designed larger than necessary. In addition, some of the motive energy of the high-pressure pump is converted to heat, which in turn causes heating of the fuel and reduced efficiency of the internal combustion energy.

In present practice, to reduce the constant leakage, the parts are cast together. However, a reduction of the constant leakage has the disadvantages that the stability behavior of the common rail system deteriorates and that automatic pressure control becomes more difficult. This becomes clear in the low-load range, because here the injection quantity, i.e., the removed fuel volume, is very small. This also becomes clear in a load reduction from 100% to 0%, since here the injection quantity is reduced to zero, and therefore the rail pressure is only slowly reduced again. This in turn results in a long correction time.

SUMMARY OF THE INVENTION

Proceeding from a common rail system with automatic rail pressure control by a suction throttle on the low-pressure side and with reduced constant leakage, the objective of the invention is to optimize the stability behavior and the correction time.

The method consists not only in providing closed-loop rail pressure control by means of the suction throttle on the low-pressure side as the first pressure regulator, but also in generating a rail pressure disturbance variable for influencing the rail pressure by means of a pressure control valve on the high-pressure side as a second pressure regulator. Fuel is redirected from the rail into a fuel tank by the pressure control valve on the high-pressure side. The invention thus consists in reproducing a constant leakage by means of the open-loop control of the pressure control valve. The rail pressure disturbance variable is computed by a pressure control valve input-output map as a function of the actual rail pressure and a set volume flow of the pressure control valve. The set volume flow in turn is computed by a set volume flow input-output map as a function of a set injection quantity and an engine speed. In a torque-based structure, a set torque is used as the input variable for the set volume flow input-output map instead of the set injection quantity. The set volume flow input-output map is realized in such a form that in a low-load range, a set volume flow with a positive value, for example, 2 liters/minute computed, while in a normal operating range, a set volume flow of zero is computed. In accordance with the invention, a low-load range is understood to mean the range of small injection quantities and thus low engine output.

Since the fuel is redirected only in the low-load range and in small quantities, there is no significant increase in the fuel temperature and also no significant reduction of the efficiency of the internal combustion engine. The increased stability of the closed-loop high-pressure control system in the low-load range can be recognized, for example, from the fact that the rail pressure in the coasting range remains more or less constant and that during a load reduction, the peak value of the rail pressure has a significantly reduced level.

In one embodiment of the invention, to improve precision, it is further provided that the rail pressure disturbance variable is additionally determined by a subordinate closed-loop current control system or, alternatively, by a subordinate closed-loop current control system with input control.

The drawings illustrate a preferred embodiment of the invention.

BRIEF DESCRIPTION OF THE DRAWING

FIG. 4 is a closed-loop current control system.

FIG. 5 is a closed-loop current control system with input control.

FIG. 6 is a set volume flow input-output map.

DETAILED DESCRIPTION OF THE INVENTION

Figure 1:
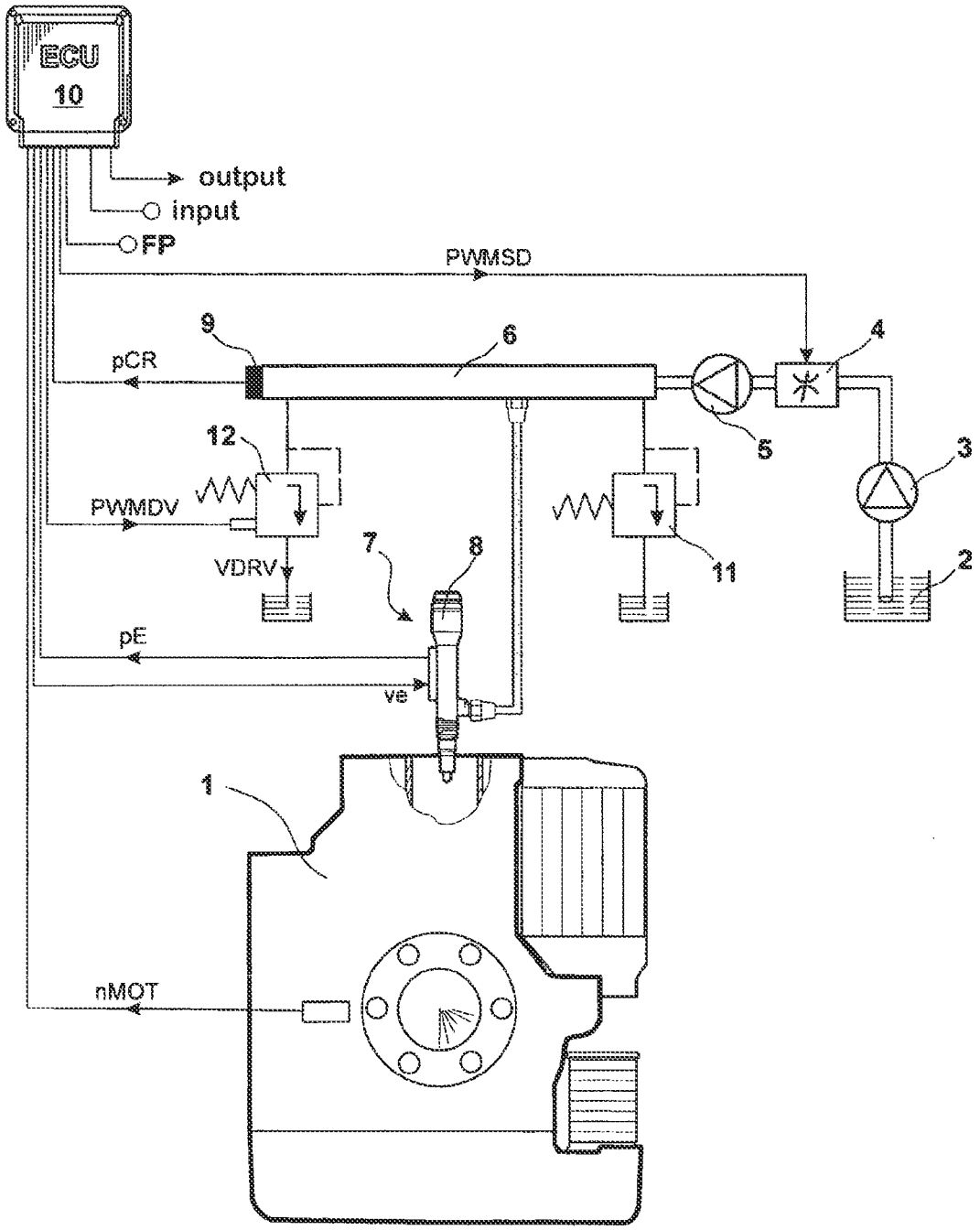
FIG. 1 is a system diagram.

FIG. 1 shows a system diagram of an electronically controlled internal combustion engine 1 with a common rail system. The common rail system comprises the following mechanical components: a low-pressure pump 3 for pumping fuel from a fuel tank 2, a variable suction throttle 4 on the low-pressure side for controlling the fuel volume flow flowing through the lines, a high-pressure pump 5 for pumping the fuel at increased pressure, a rail 6 for storing the fuel, and injectors 7 for injecting the fuel into the combustion chambers of the internal combustion engine 1. Optionally, the common rail system can also be realized with individual accumulators, in which case an individual accumulator 8 is integrated, for example, in the injector 7 as an additional buffer volume. To protect against an impermissibly high pressure level in the rail 6, a passive pressure control valve 11 is provided, which, in its open state, redirects the fuel from the rail 6. An electrically controllable pressure control valve 12 also connects the rail 6 with the fuel tank 2. A fuel volume flow redirected from the rail 6 into the fuel tank 2 is defined by the position of the pressure control valve 12. In the remainder of the text, this fuel volume flow is denoted the rail pressure disturbance variable VDRV.

The operating mode of the internal combustion engine 1 is determined by an electronic control unit (ECU) 10. The electronic control unit 10 contains the usual components of a microcomputer system, for example, a microprocessor, interface adapters, buffers and memory components (EEPROM, RAM). Operating characteristics that are relevant to the operation of the internal combustion engine 1 are applied in the memory components in the form of input-output maps/characteristic curves. The electronic control unit 10 uses these to compute the output variables from the input variables. FIG. 1 shows the following input variables as examples: the rail pressure pCR, which is measured by means of a rail pressure sensor 9, an engine speed nMOT, a signal FP, which represents an engine power output desired by the operator, and an input variable INPUT, which represents additional sensor signals, for example, the charge air pressure of an exhaust gas turbocharger. In a common rail system with individual accumulators 8, the individual accumulator pressure pE is an additional input variable of the electronic control unit 10.

FIG. 1 also shows the following as output variables of the electronic control unit 10: a signal PWMSD for controlling the suction throttle 4 as the first pressure regulator, a signal ve for controlling the injectors 7 (injection start/injection end), a signal PWMDV for controlling the pressure control valve 12 as the second pressure regulator, and an output variable OUTPUT. The output variable OUTPUT is representative of additional control signals for the open-loop and closed-loop control of the internal combustion engine 1, for example, a control signal for activating a second exhaust gas turbocharger during a register supercharging.

Figure 2:
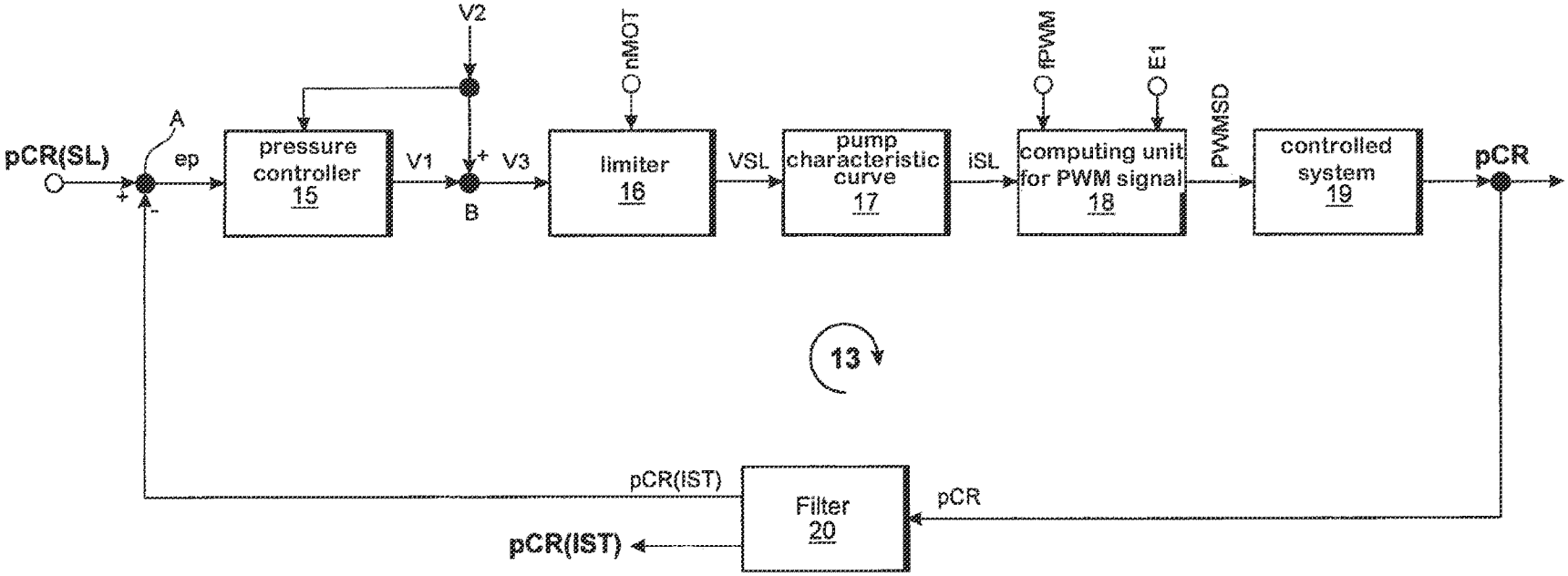
FIG. 2 is a closed-loop rail pressure control system.
Figure 3:
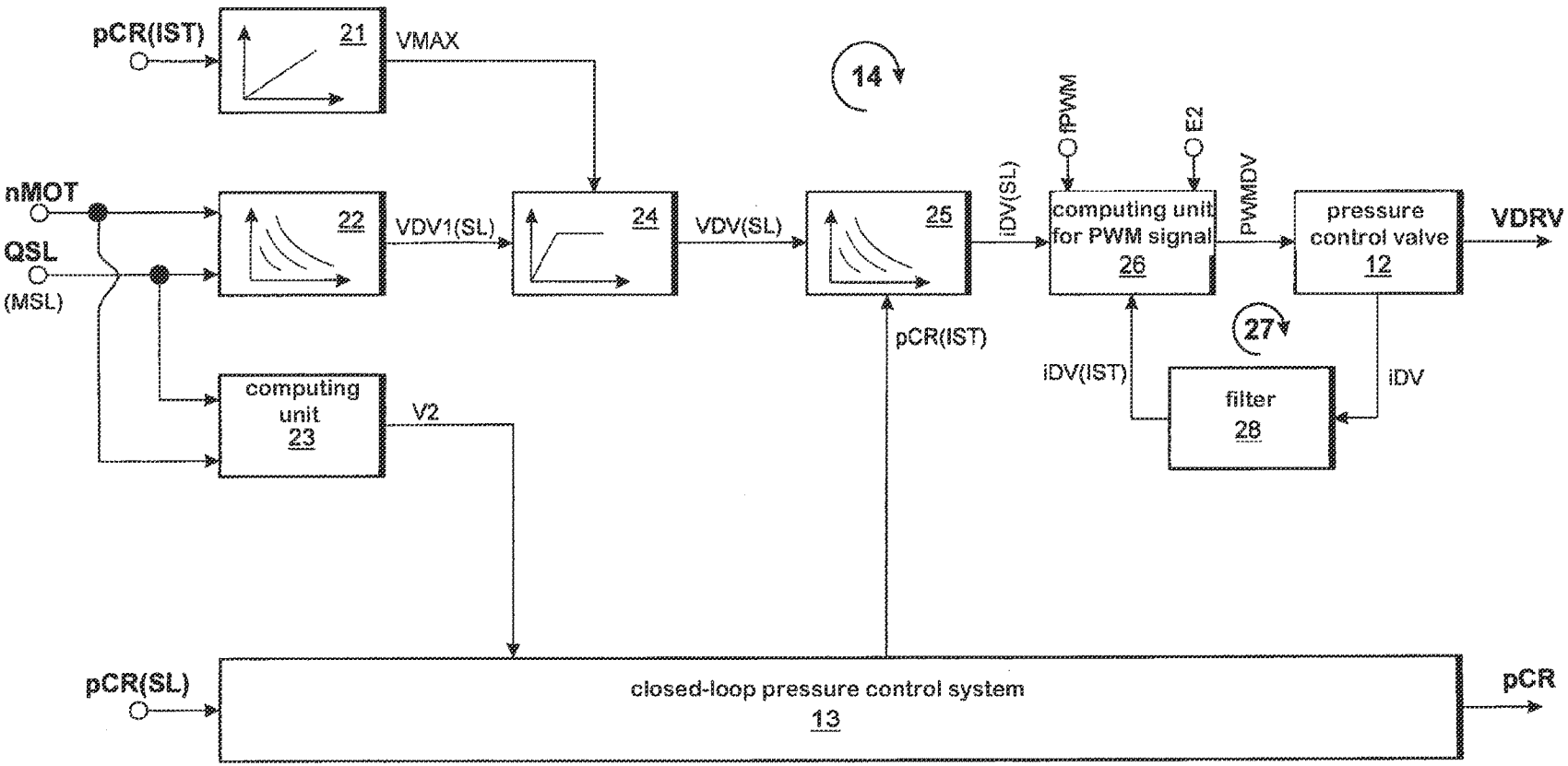
FIG. 3 is a block diagram

FIG. 2 shows a closed-loop rail pressure control system 13 for automatically controlling the rail pressure pCR. The input variables of the closed-loop rail pressure control system 13 are: a set rail pressure pCR(SL), a set consumption V2, the engine speed nMOT, the PWM base frequency fPWM, and a variable E1. The variable E1 combines, for example, the battery voltage and the ohmic resistance of the suction throttle coil with lead-in wire, which enter into the computation of the PWM signal. A first output variable of the closed-loop rail pressure control system 13 is the raw value of the rail pressure pCR. A second output variable of the closed-loop rail pressure control system 13 is the actual rail pressure pCR(IST), which is further processed in an open-loop control system 14 (FIG. 3). The actual rail pressure pCR(IST) is computed from the raw value of the rail pressure pCR by means of a filter 20. This value is then compared with the set value pCR(SL) at a summation point A, and a control deviation ep is obtained from this comparison. A correcting variable is computed from the control deviation ep by a pressure controller 15. The correcting variable represents a volume flow V1 with the physical unit of liters/minute. The computed set consumption V2 is added to the volume flow V1 at a summation point B. The set consumption V2 is computed by a computing unit 23, which is shown in FIG. 3 and will be explained in connection with the description of FIG. 3. The result of the addition at summation point B represents the volume flow V3, which is the input variable of a limiter 16, which limits the volume flow V3 as a function of the engine speed nMOT to generate a set volume flow VSL as its output variable. If the volume flow V3 is below the limit of the limiter 16, the value of the set volume flow VSL equals the value of the volume flow V3. The set volume flow VSL is the input variable of a pump characteristic curve 17, which assigns a set electric current iSL to the set volume flow VSL. The set current iSL is then converted to a PWM signal PWMSD by a computing unit 18. The PWM signal PWMSD represents the duty cycle, and the frequency fPWM corresponds to the base frequency. The magnetic coil of the suction throttle is then acted upon by the PWM signal PWMSD. This changes the displacement of the magnetic core, and the output of the high-pressure pump is freely controlled in this way. For safety reasons, the suction throttle is open in the absence of current and is acted upon by current via PWM activation to move in the direction of the closed position. A closed-loop current control system can be subordinate to the PWM signal computing unit 18, as described in DE 10 2004 061 474 A1. The high-pressure pump, the suction throttle, the rail, and possibly the individual accumulators represent a controlled system 19. The closed-loop control system is thus closed.

FIG. 3 in the form of a block diagram shows the greatly simplified closed-loop rail pressure control system 13 of FIG. 2 and an open-loop control system 14. The open-loop control system 14 generates the rail pressure disturbance variable VDRV. The input variables of the open-loop control system 14 are: the actual rail pressure pCR(IST), the engine speed nMOT, and a set injection quantity QSL. The set injection quantity QSL is either computed by an input-output map as a function of the power desired by the operator or represents the correcting variable of a speed controller. The physical unit of the set injection quantity QSL is $mm^3$/stroke. In a torque-oriented structure, a set torque MSL is used instead of the set injection quantity QSL. A first output variable is the rail pressure disturbance variable VDRV, i.e. the fuel volume flow that is redirected from the rail into the fuel tank by the pressure control valve. A second output variable is the set consumption V2, which is further processed in the closed-loop rail pressure control system 13. A maximum volume flow VMAX (unit: liters/minute) is assigned to the actual rail pressure pCR(IST) by a characteristic curve 21. The characteristic curve 21 is realized, for example, as an increasing straight line with end values of A (0 bars, 0 L/min) and B (2200 bars, 7.5 L/min). The maximum volume flow VMAX is one of the input variables of a limiter 24.

A computing unit 23 uses the engine speed nMOT and the set injection quantity QSL to compute the set consumption V2. A set volume flow input-output map 22 (3D input-output map) likewise uses the engine speed nMOT and the set injection quantity QSL to compute a first set volume flow VDV1(SL) for the pressure control valve. The set volume flow input-output map 22 is realized in such a form that in the low-load range, for example, at idle, a positive value of the first set volume flow VDV1(SL) is computed, while in the normal operating range, a first set volume flow VDV1(SL) of zero is computed. A possible embodiment of the set volume flow input-output map 22 is shown in FIG. 6 and will be explained in detail in the description of FIG. 6. The first set volume flow VDV1(SL) has the physical unit of liters/minute. The first set volume flow VDV1(SL) is the second input variable for the limiter 24. The limiter 24 limits the first set volume flow VDV1(SL) to the value of the maximum volume flow VMAX. The output variable is the set volume flow VDV(SL) that the pressure control valve is meant to redirect from the rail into the fuel tank. If the first set volume flow VDV1(SL) is less than the maximum volume flow VMAX, the value of the set volume flow VDV(SL) is set to the value of the first set volume flow VDV1(SL). Otherwise, the value of the set volume flow VDV(SL) is set to the value of the maximum volume flow VMAX. The set volume flow VDV(SL) and the actual rail pressure pCR(IST) are the input variables of the pressure control valve input-output map 25. The pressure control valve input-output map 25 is an inversion input-output map, i.e., the physical (stationary) behavior of the pressure control valve is inverted with this input-output map. The output variable of the pressure control valve input-output map 25 is a set current iDV(SL), which is then converted to a PWM signal PWMDV by a computing unit 26 having an input variable E2. A current controller, closed-loop current control system 27, or a current controller with input control can be subordinate to the conversion. The current controller is shown in FIG. 4 and will be explained in the description of FIG. 4. The current controller with input control is shown in FIG. 5 and will be explained in the description of FIG. 5. The pressure control valve 12 is controlled with the PWM signal PWMDV. The electric current iDV that occurs at the pressure control valve 12 is converted for current control to an actual current iDV(IST) by a filter 28 and fed back to the computing unit 26 for the PWM signal. The output signal of the pressure control valve 12 is the rail pressure disturbance variable VDRV, i.e., the fuel volume flow that is redirected from the rail into the fuel tank.

FIG. 4 shows a pure current controller. The input variables are the set current iDV(SL), the actual current iDV(IST), the battery voltage UBAT, and controller parameters (kp, Tn). The output variable is the PWM signal PWMDV, with which the pressure control valve is controlled. First, the current control deviation ei is computed from the set current iDV(SL) and the actual current iDV(IST) (see FIG. 3). The current control deviation ei is the input variable of the current controller 29. The current controller 29 can be realized as a PI or PI(DT1) algorithm. The controller parameters are processed in the algorithm. They are characterized, for example, by the proportional coefficient kp and the integral-action time Tn. The output variable of the current controller 29 is a set voltage UDV(SL) of the pressure control valve. This is divided by the battery voltage UBAT and then multiplied by 100. The result is the duty cycle of the pressure control valve in percent.

FIG. 5 shows a current controller with combined input control. The input variables are the set current iDV(SL), the actual current iDV(IST), the controller parameters (kp, Tn), the ohmic resistance RDV of the pressure control valve, and the battery voltage UBAT. The output variable is again the PWM signal PWMDV, with which the pressure control valve is controlled. First, the set current iDV(SL) is multiplied by the ohmic resistance RDV. The result is a pilot voltage UDV(VS). The set current iDV(SL) and the actual current iDV(IST) are used to compute the current control deviation ei. The current controller 29 then uses the current control deviation ei to compute the set voltage UDV(SL) of the current controller as a correcting variable. Here again, the current controller 29 can be realized either as a PI controller or as a PI(DT1) controller. The set voltage UDV(SL) and the pilot voltage UDV(VS) are then added, and the sum is divided by the battery voltage UBAT and then multiplied by 100.

FIG. 6 shows the set volume flow input-output map 22, with which the first set volume flow VDV1(SL) for the pressure control valve is determined. The first set volume flow VDV1(SL) and the set volume flow VDV(SL) are identical as long as the first set volume flow VDV1(SL) is less than the maximum volume flow VMAX (FIG. 3: limiter 24). The input variables are the engine speed nMOT and the set injection quantity QSL. Engine speed (nMOT) values of 0 to 2000 rpm are plotted in the horizontal direction, and set injection quantity (QSL) values of 0 to 270 $mm^3$/stroke are plotted in the vertical direction. The values inside the input-output map then represent the assigned first set volume flow VDV1(SL) in liters/minute. The fuel volume flow to be redirected, i.e., the rail pressure disturbance variable, is determined by the set volume flow input-output map 22. The set volume flow input-output map 22 is realized in such a form that in the normal operating range, a first set volume flow of VDV1(SL)=0 liters/minute is computed. The normal operating range is outlined by a double line in FIG. 6. The region outlined by a single line corresponds to the low-load range. In the low-load range, a positive value of the first set volume flow VDV1(SL) is computed. For example, at nMOT=1000 rpm and QSL=30 $mm^3$/stroke, a first set volume flow of VDV1(SL)=1.5 liters/minute is determined.

FIG. 7 is a time chart showing a load rejection from 100% to 0% load in an internal combustion engine which is being used to power an emergency power generating unit (60-Hz generator). FIG. 7 comprises five separate graphs 7A to 7E, which show the following as a function of time: the engine speed nMOT in FIG. 7A, the set injection quantity QSL in FIG. 7B, the suction throttle current iSD in FIG. 7C, the actual rail pressure pCR(IST) in FIG. 7D, and the set volume flow VDV(SL) in FIG. 7E. The broken lines in FIGS. 7C and 7D show the behavior without the pressure control valve, while the solid lines show the behavior with control by the pressure control valve. In the time range of the graphs, the set engine speed is constant (1800 rpm) and the set rail pressure is constant (1800 bars). The set engine speed is identical to the rated engine speed here.

Figure 7A:
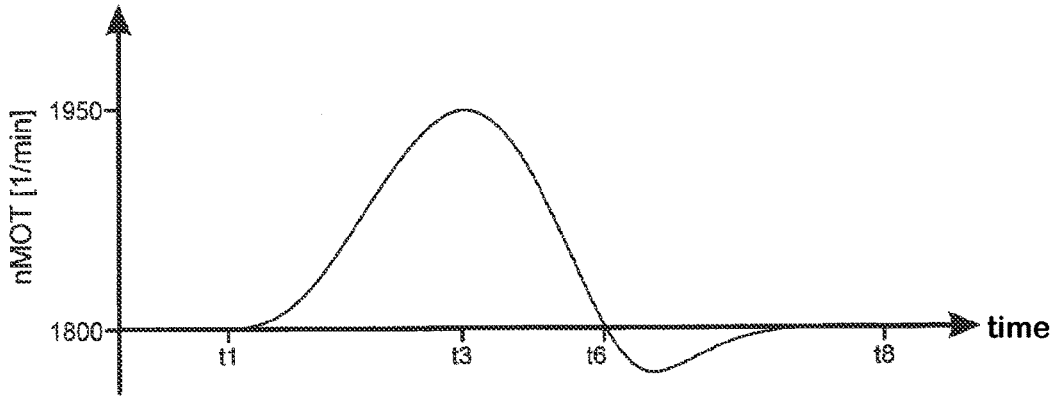
FIG. 7 is a time chart.
Figure 7B:
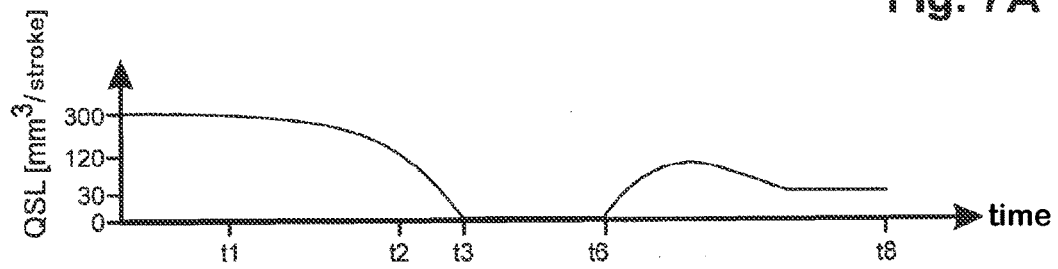
Figure 7C:
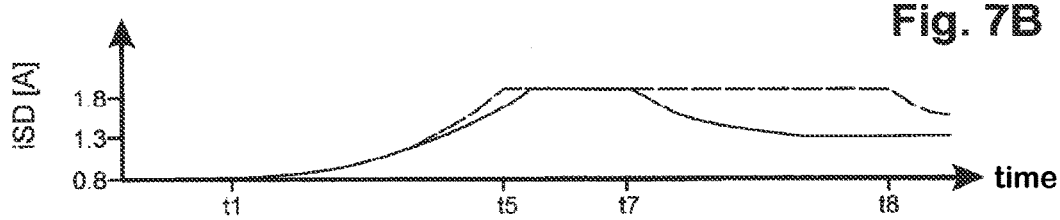

FIG. 7A shows the engine speed nMOT, which initially rises after the load rejection, time t1, and then swings back to the rated engine speed nMOT=1800 rpm. As the engine speed nMOT rises, the set injection quantity QSL falls from its initial value of QSL=300 $mm^3$/stroke (FIG. 7B). At time t3, it reaches a value of QSL=0 $mm^3$/stroke. At time t6, the engine speed nMOT swings below the rated engine speed, which leads to an increase in the set injection quantity QSL starting at time t6. When the nMOT has oscillated back to its steady state, so has too the set injection quantity QSL, namely, to the idle value of about QSL=30 $mm^3$/stroke.

The behavior without the pressure control valve and its activation (broken-line curves) is as follows.

Figure 7D:
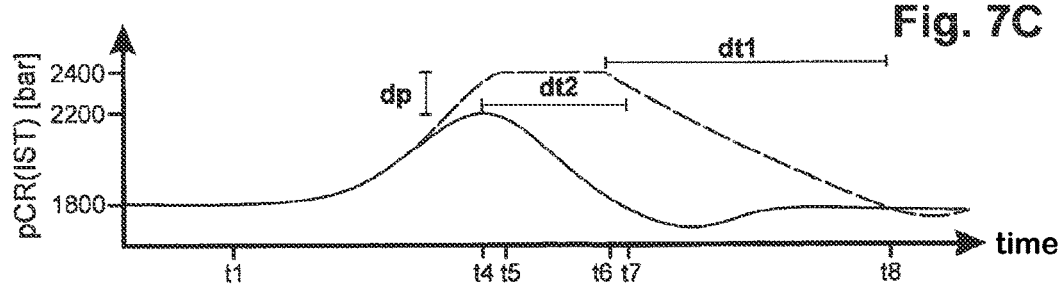
Figure 7E:
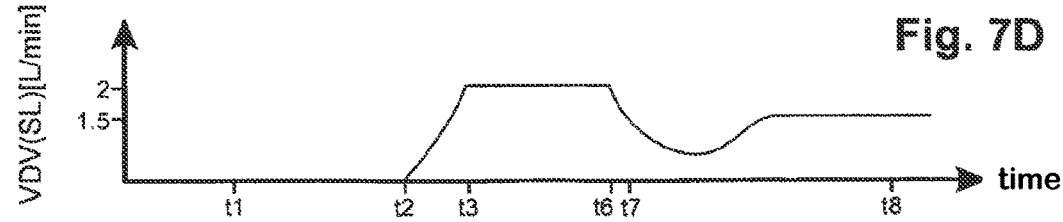

With rising engine speed nMOT and falling set injection quantity QSL starting at time t1, the actual rail pressure pCR(IST) rises (see FIG. 7D). Since the rail pressure pCR is automatically controlled, a negative control deviation ep (FIG. 2) is generated at constant set rail pressure pCR(SL), so that the pressure controller acts on the suction throttle in the closing direction. This occurs by means of a rising suction throttle current iSD. At time t5, the suction throttle current iSD reaches its maximum value of iSD=1.8 A (see FIG. 7C). The suction throttle is now completely closed. Since at the same time the set injection quantity QSL=0 $mm^3$/stroke, the actual rail pressure pCR(IST) reaches its maximum value of pCR(IST)=2400 bars at time t5 and remains at this level. At time t6, the set injection quantity QSL starts to rise again, so that the actual rail pressure pCR(IST) now starts to fall. Since the rail pressure control deviation is still negative, the suction throttle current iSD is also still at its maximum value iSD=1.8 A, i.e., the suction throttle remains closed. Due to the small injection quantity during idling, the actual rail pressure pCR(IST) drops only very slowly. At time t8, the actual rail pressure pCR(IST) finally arrives back at the level of the set rail pressure (here: 1800 bars). The actual rail pressure pCR(IST) then undershoots the set rail pressure, with the result that a positive rail pressure control deviation is obtained for a brief period of time. The consequence of this is that after time t8 the suction throttle current iSD decreases and levels off at a lower level.

The behavior with the use of the pressure control valve (solid-line curves) is as follows:

At time t2, the set injection quantity QSL falls below the value QSL=120 $mm^3$/stroke, as a result of which the set volume flow input-output map (FIG. 6) computes an increasing first set volume flow VDV1(SL) and an increasing set volume flow VDV(SL). The set injection quantity QSL now drops all the way to QSL=0 $mm^3$/stroke, which causes the set volume flow to rise to VDV(SL)=2 liters/min by time t3 (see FIG. 7E). The set injection quantity QSL remains at the value QSL=0 $mm^3$/stroke until time t6. Accordingly, the set volume flow also remains at the value VDV(SL)=2 liters/minute. After time t6, the set injection quantity QSL rises and then levels off to the idle value of QSL=30 $mm^3$/stroke. The set volume flow VDV(SL) for the pressure control valve shows a corresponding drop after time t6 and levels off at the value VDV(SL)=1.5 liters/minute. Since the set volume flow VDV(SL) and thus the fuel volume flow redirected by the pressure control valve rise at time t2, the rise of the actual rail pressure pCR(IST) is retarded. At time t4, the actual rail pressure pCR(IST) reaches its peak value of pCR(IST)=2200 bars (FIG. 7D). The subsequent drop in the actual rail pressure pCR(IST) occurs more rapidly due to the redirected amount of fuel, so that the rated pressure (1800 bars) has already been reached again at time t7. Since the actual rail pressure pCR(IST) increases more slowly starting at time t2 due to the redirection of the fuel by the pressure control valve, the suction throttle current iSD also rises more slowly. As a result, it reaches its maximum value of iSD=1.8 A later (see FIG. 7C). Starting at time t7, a positive rail pressure control deviation is generated, so that the suction throttle current iSD decreases. Since a set volume flow of VDV(SL)=1.5 liters/minute is now being redirected at idling speed, the suction throttle current iSD reaches a lower level of iSD=1.3 A at idling speed.

The graphs in FIG. 7 show that the redirection of the fuel by the pressure control valve leads to a reduction of the peak value of the actual rail pressure pCR(IST). In FIG. 7D, this pressure difference is denoted dp. In addition, the correction time of the actual rail pressure pCR(IST) after a load reduction is reduced by the redirection of the fuel. In FIG. 7D, the correction time without the pressure control valve is denoted dt1 and the correction time with the pressure control valve is denoted dt2. All together, in the low-load range, the stability of the high-pressure closed-loop control system is increased without a significant increase in the fuel temperature or reduction of the efficiency of the internal combustion engine.

Figure 8:
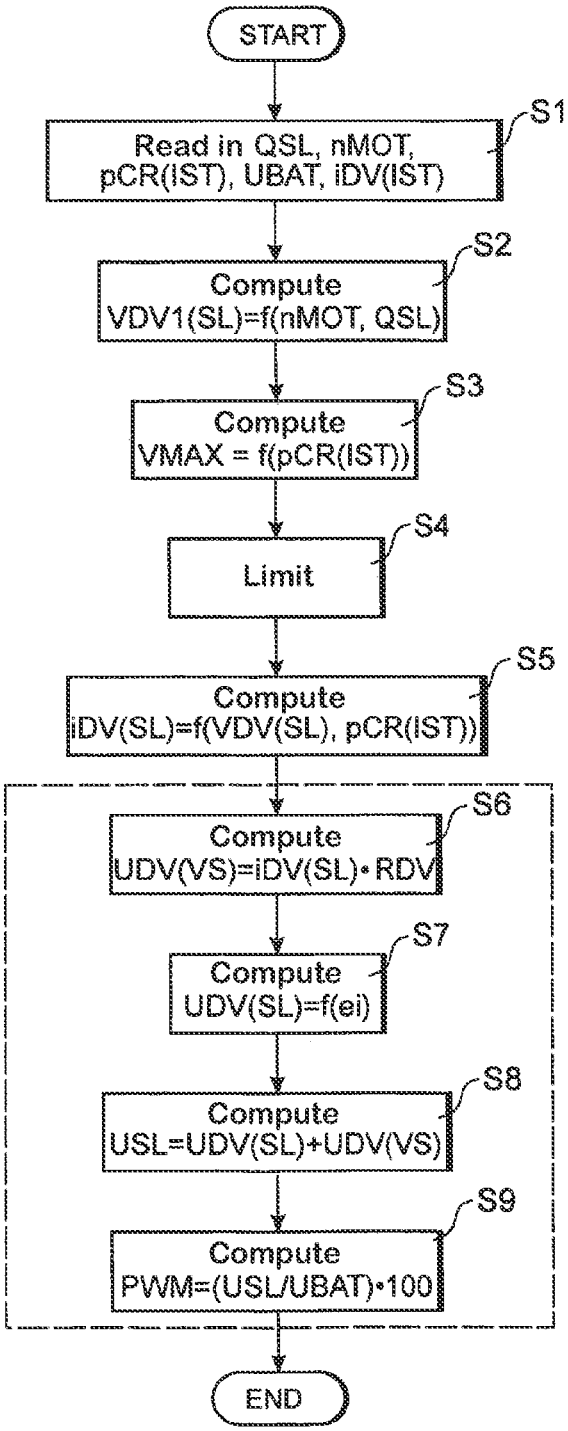
FIG. 8 is a program flowchart.

FIG. 8 is a program flowchart of the method for determining the rail pressure disturbance variable. Steps S6 to S9 contain the organization of the closed-loop current control system with input control. At S1 the set injection quantity QSL, the engine speed nMOT, the actual rail pressure pCR(IST), the battery voltage UBAT, and the actual current iDV(IST) of the pressure control valve are read in. Then at S2 the first set volume flow VDV1(SL) is computed by the set volume flow input-output map as a function of the set injection quantity QSL and the engine speed nMOT. At S3 a maximum volume flow VMAX is computed from the actual rail pressure pCR(IST) (FIG. 3: 21), and at S4 the first set volume flow VDV1(SL) is limited to the maximum volume flow VMAX. If the first set volume flow VDV1(SL) is less than the maximum volume flow VMAX, then the set volume flow VDV(SL) is set to the value of the first set volume flow VDV1(SL). Otherwise, the set volume flow VDV(SL) is set to the value of the maximum volume flow VMAX. At S5 the set current iDV(SL) is computed as a function of the set volume flow VDV(SL) and the actual rail pressure pCR(IST). At S6 a pilot voltage UDV(VS) is computed by multiplying the set current iDV(SL) by the ohmic resistance RDV of the pressure control valve and the lead-in wire. At S7 a set voltage UDV(SL) is computed as a correcting variable of the current controller as a function of the current control deviation ei. Then at S8 the set voltage UDV(SL) for the pressure control valve and the pilot voltage UDV(VS) are added. At S9 the result is then divided by the battery voltage UBAT and multiplied by 100 to obtain the duty cycle of the pWM signal for activating the pressure control valve. The program then ends.

LIST OF REFERENCE NUMBERS

1 internal combustion engine
2 fuel tank
3 low-pressure pump
4 suction throttle
5 high-pressure pump
6 rail
7 injector
8 individual accumulator (optional)

9 rail pressure sensor
10 electronic control unit (ECU)
11 pressure control valve, passive
12 pressure control valve, electrically controllable
13 closed-loop rail pressure control system
14 open-loop control system
15 pressure controller
16 limiter
17 pump characteristic curve
18 computing unit for PWM signal
19 controlled system
20 filter
21 characteristic curve
22 set volume flow input-output map
23 computing unit
24 limiter
25 pressure control valve input-output map
26 computing unit for PWM signal
27 closed-loop current control system (pressure control valve)
28 filter
29 current controller

The invention claimed is:

1. A method for open-loop and closed-loop control of an internal combustion engine, comprising the steps of:

controlling maximum rail pressure by a passive pressure control valve connected directly to the rail by a first independent discharge line;

automatically controlling rail pressure (pCR) in a closed-loop rail pressure control system by a suction throttle on a low-pressure side as a first pressure regulator;

generating a rail pressure disturbance variable (VDRV) for influencing the rail pressure (pCR) by way of a pressure control valve on a high-pressure side as a second pressure regulator, by which fuel is redirected from the rail into a fuel tank in order to reproduce a constant leakage by an open-loop control of the pressure control valve, including computing the rail pressure disturbance variable (VDRV) as a function of actual rail pressure (pCR(IST)) and a set volume flow (VDV(SL)) of the pressure control valve by a pressure control valve input-output map, and further including realizing a set volume flow input-output map in a form so that in a low-load range, a set volume flow (VDV (SL)) with a positive value is computed, and in a normal operating range, a set volume flow (VDV(SL)) of zero is computed, wherein the set volume flow and a first set volume flow are identical as long as the first set volume flow is less than a maximum volume flow, the pressure control valve being connected directly to the rail by a second independent discharge line.

2. The method according to claim 1, including computing the set volume flow (VDV(SL)) of the pressure control valve as a function of a set injection quantity (QSL) or, alternatively, a set torque (MSL) and an engine speed (nMOT) by a set volume flow input-output map.

3. The method according to claim 1, including limiting the set volume flow (VDV(SL)) as a function of the actual rail pressure (pCR(IST)).

4. The method according to claim 1, including additionally determining the rail pressure disturbance variable (VDRV) by a subordinate closed-loop current control system.

5. The method according to claim 1, including additionally determining the rail pressure disturbance variable (VDRV) by a subordinate closed-loop current control system with input control.

* * * * *